US012071956B2

(12) United States Patent
Vaughan et al.

(10) Patent No.: US 12,071,956 B2
(45) Date of Patent: Aug. 27, 2024

(54) FAN SHROUD AND FAN ASSEMBLY HAVING FAN SHROUD

(71) Applicant: TECHTRONIC CORDLESS GP, Anderson, SC (US)

(72) Inventors: Braden Vaughan, Greenville, SC (US); Venkat Praveen Gambhir, Greenville, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 18/153,085

(22) Filed: Jan. 11, 2023

(65) Prior Publication Data

US 2024/0229822 A1 Jul. 11, 2024

(51) Int. Cl.

| | |
|---|---|
| ***F04D 29/42*** | (2006.01) |
| ***F04D 25/06*** | (2006.01) |
| ***F04D 25/08*** | (2006.01) |
| ***F04D 29/70*** | (2006.01) |

(52) U.S. Cl.

CPC ..... *F04D 29/4226* (2013.01); *F04D 25/0673* (2013.01); *F04D 25/08* (2013.01); *F04D 29/703* (2013.01)

(58) Field of Classification Search

CPC .. F04D 29/4226; F04D 25/0673; F04D 25/08; F04D 29/703

See application file for complete search history.

(56) References Cited

U.S. PATENT DOCUMENTS

| | | | | |
|---|---|---|---|---|
| 4,567,483 | A | 1/1986 | Bateman et al. | |
| 2020/0208654 | A1* | 7/2020 | Weinmeister | F04D 25/084 |
| 2022/0290680 | A1* | 9/2022 | Metcalf | F04D 29/703 |

FOREIGN PATENT DOCUMENTS

| | | | |
|---|---|---|---|
| CN | 102478027 | B | 6/2015 |
| DE | 7736584 | U1 | 3/1978 |
| EP | 2387670 | B1 | 12/2017 |

OTHER PUBLICATIONS

Extended European Search Report for Application No. 23217891.3 dated May 24, 2024 (9 pages).

* cited by examiner

*Primary Examiner* — Grant Moubry
*Assistant Examiner* — Ruben Picon-Feliciano
(74) *Attorney, Agent, or Firm* — Michael Best & Friedrich LLP

(57) ABSTRACT

A fan assembly includes a motor having an output shaft, a plurality of fan blades coupled to the output shaft and configured to be rotated by the output shaft when the motor is actuated to generate airflow in an airflow direction, and a fan shroud surrounding the plurality of fan blades. The fan shroud comprises a converging section that decreases in diameter in the airflow direction, and a constant diameter section downstream of the converging section in the airflow direction that has a substantially constant diameter.

19 Claims, 9 Drawing Sheets

FAN SHROUD AND FAN ASSEMBLY HAVING FAN SHROUD

FIELD

The present disclosure relates generally to a fan having a fan shroud.

BACKGROUND

There are various cooling devices for cooling an area and/or users. One such device is a fan, which generally include spinning fan blades that produce airflow for cooling the area and/or user.

SUMMARY

Aspects and advantages of one or more embodiments of the invention in accordance with the present disclosure will be set forth in part in the following description, may be understood from the description, or may be learned through practice of the technology.

According to one or more embodiments, a fan assembly comprises a motor having an output shaft, a plurality of fan blades coupled to the output shaft and configured to be rotated by the output shaft when the motor is actuated to generate airflow in an airflow direction, a fan shroud surrounding the plurality of fan blades, wherein the fan shroud comprises a converging section that decreases in diameter in the airflow direction, and a constant diameter section downstream of the converging section in the airflow direction that has a substantially constant diameter.

According to one or more embodiments, the fan shroud further comprises a diverging section downstream of the converging section and upstream of the constant diameter section that increases in diameter in the airflow direction.

According to one or more embodiments, the constant diameter section of the fan shroud surrounds an entirety of the plurality of fan blades.

According to one or more embodiments, the converging section surrounds at least a portion of the motor.

According to one or more embodiments, the diverging section surrounds at least a portion of the motor.

According to one or more embodiments, a first portion of the motor is surrounded by the converging section, a second portion of the motor is surrounded by the diverging section, and a third portion of the motor is surrounded by the constant diameter section.

According to one or more embodiments, a majority of the converging section has a smaller diameter than a diameter of the constant diameter section.

According to one or more embodiments, the fan assembly comprises a first lip upstream of the converging section and a second lip downstream of the constant diameter section.

According to one or more embodiments, the fan assembly comprises a battery receptacle disposed on the fan shroud electrically connected to the motor and configured to receive a battery pack to provide power to the motor.

According to one or more embodiments, a rear grill is disposed upstream of the fan blades, and the rear grill extends in the airflow direction from the converging section to the diverging section.

According to one or more embodiments, a length of the constant diameter section in the airflow direction in greater than a length of the converging section in the airflow direction.

According to one or more embodiments, a length of the constant diameter section in the airflow direction in greater than a length of the diverging section in the airflow direction.

According to one or more embodiments, a length of the constant diameter section in the airflow direction in less than a length of a combination of the converging section and the diverging section and in the airflow direction.

A fan shroud configured to have airflow therethrough in an airflow direction comprises a converging section that decreases in diameter in the airflow direction, and a constant diameter section downstream of the converging section in the airflow direction that has a substantially constant diameter.

According to one or more embodiments, the fan shroud further comprises a diverging section downstream of the converging section and upstream of the constant diameter section that increases in diameter in the airflow direction.

According to one or more embodiments, a majority of the converging section has a smaller diameter than a diameter of the constant diameter section.

According to one or more embodiments, the fan shroud comprises a first lip upstream of the converging section and a second lip downstream of the constant diameter section.

These and other features, aspects and advantages of one or more embodiments of the present invention will become better understood with reference to the following description and appended claims. The accompanying drawings, which are incorporated in and constitute a part of this specification, illustrate embodiments of the technology and, together with the description, serve to explain the principles of the technology.

DETAILED DESCRIPTION

Figure 1:
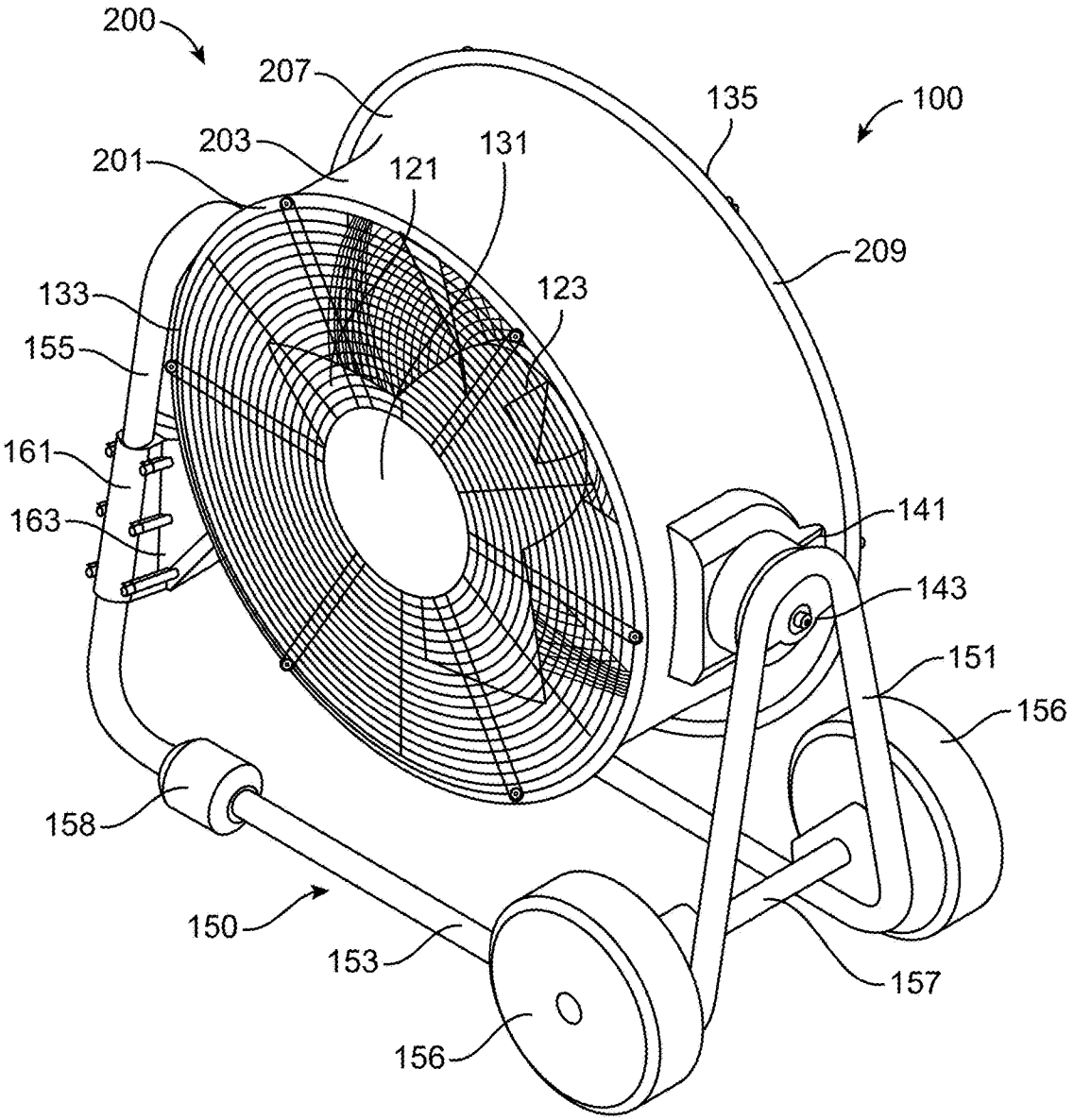
FIG. 1 shows a front perspective view of a fan assembly according to one or more embodiments.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive- or. For example, a condition A or B is satisfied by any one of the following: A is true (or present) and B is false (or not present), A is false (or not present) and B is true (or present), and both A and B are true (or present).

Terms of approximation, such as "about," "generally," "approximately," or "substantially," include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Figure 2:
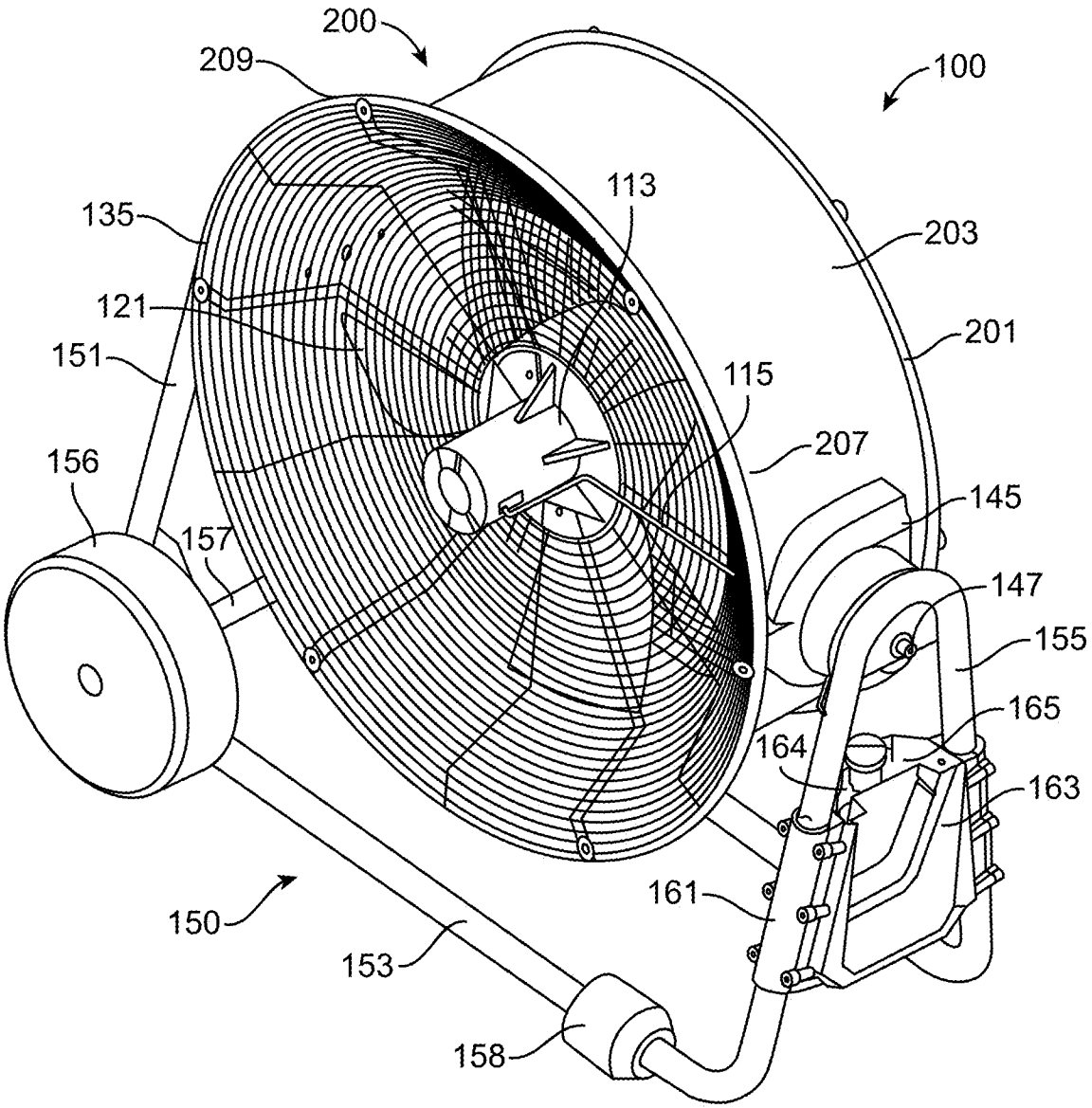
FIG. 2 shows a rear perspective view of a fan assembly according to one or more embodiments.
Figure 3:
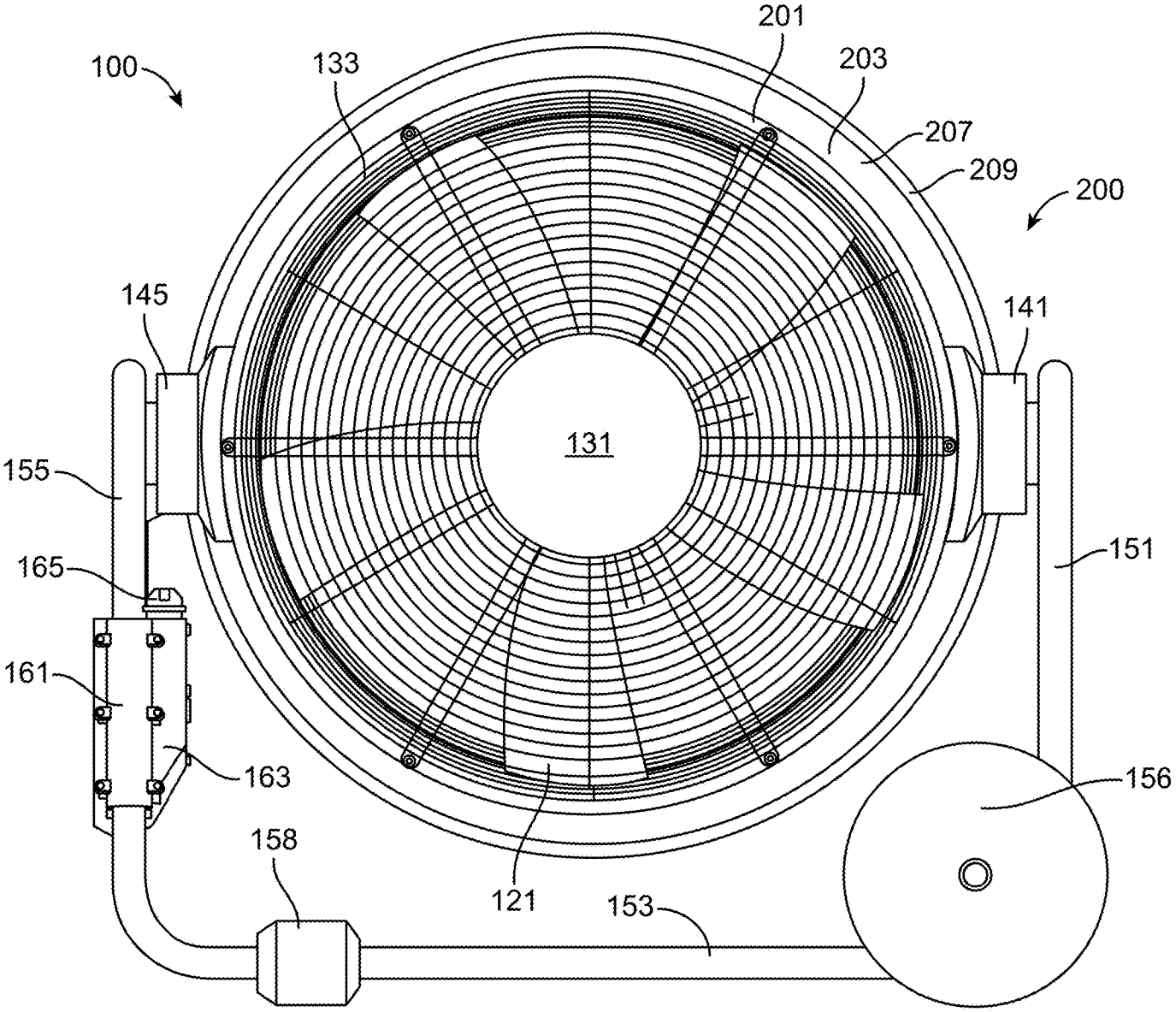
FIG. 3 shows a front view of a fan assembly according to one or more embodiments.
Figure 4:
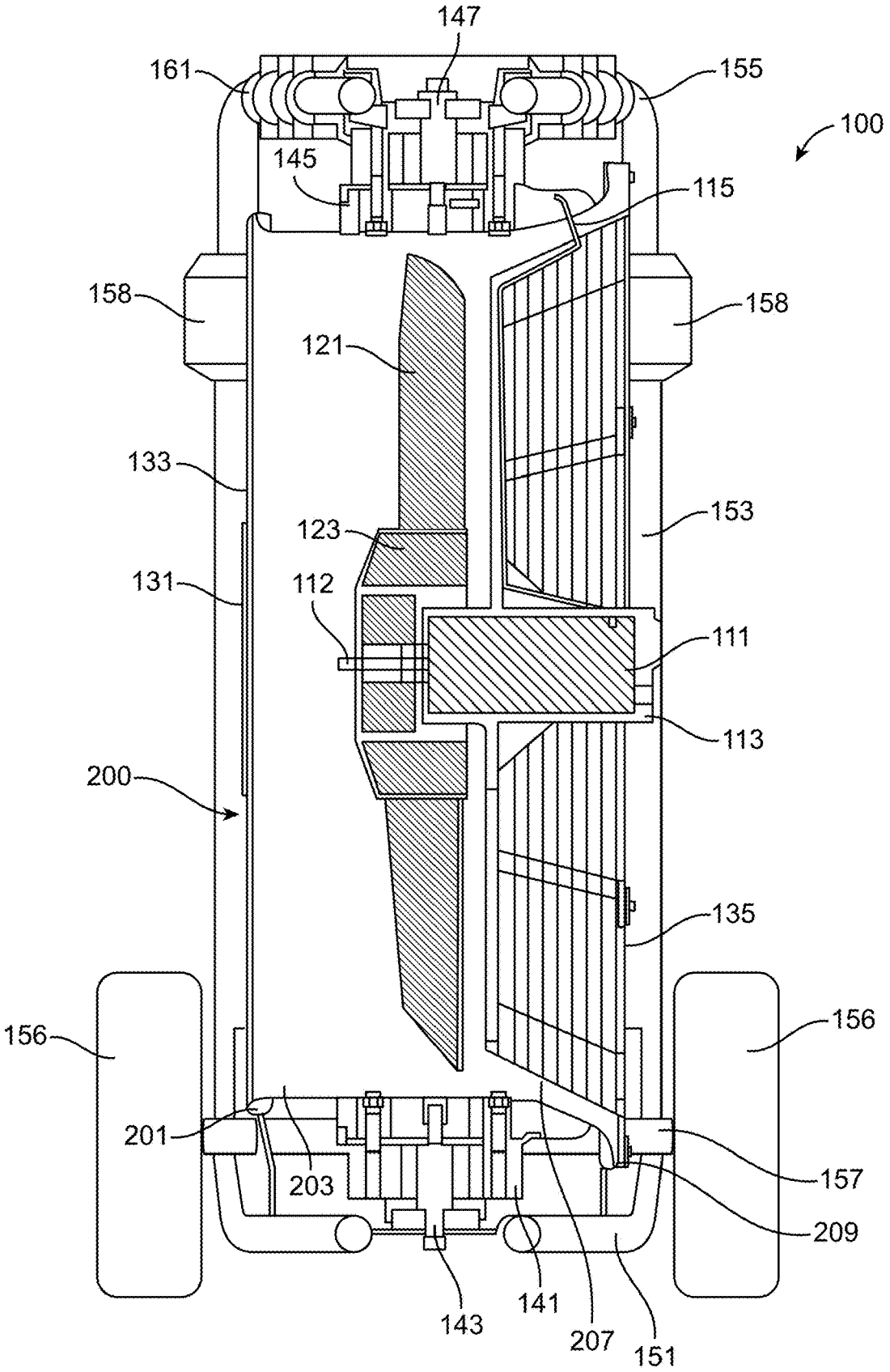
FIG. 4 shows a top cross-sectional view of a fan assembly according to one or more embodiments.

FIGS. 1-3 show front perspective, rear perspective, and front views of a fan assembly 100 according to one or more embodiments. FIG. 4 shows a top cross-sectional view of the fan assembly 100 according to one or more embodiments. Referring to FIG. 4, the fan assembly 100 includes a motor 111. According to one or more embodiments, the motor 111 may be a brushed motor, a brushless motor, or other motors known for use in fans. The motor 111 is disposed within a motor housing 113. According to one or more embodiments, the motor 111 is fully enclosed in the motor housing 113. According to one or more embodiments, the motor housing 113 may be water-proof and/or dust-proof. The motor 111 includes an output shaft 112. According to one or more embodiments, the output shaft 112 extends from the motor 111 in a forward direction. A fan hub 123 is fixed to the output shaft 112 such that the fan hub 123 rotates with the output shaft 112 when the motor 111 is actuated and the output shaft 112 is thereby rotated. A plurality of fan blades 121 extend outward in a radial direction from the fan hub 123. While FIG. 3 shows the fan assembly 111 having five fan blades 121, the present disclosure is not limited thereto. The fan blades 121 are fixed to the fan hub 123 such that rotation of the fan hub 123 results in a rotation of the fan blades 121, and the fan blades 121 generates airflow in the forward direction, which is the left direction in FIG. 4. According to one or more embodiments, the fan blades 121 are formed integrally with the fan hub 123. Alternatively, the fan blades 121 may be attached to the fan hub 123. The motor 111, output shaft 112, fan hub 123, and the fan blades 121 may be collectively referred to as a fan of the fan assembly 100.

As shown in FIGS. 1-4, a fan shroud 200 is disposed around the fan blades 121. The fan shroud 200 surrounds the fan blades 121 so as to direct airflow from a rear of the fan assembly 100 to a front of the fan assembly 100. The fan shroud 200 is open at a front end and a rear end. A more detailed explanation of the fan shroud 200 will be set forth later. According to one or more embodiments, a front grill 133 is disposed on a front side of the fan shroud 200 and a rear grill 135 is disposed on a rear side of the fan shroud 200. The front grill 133 and the rear grill 135 allow airflow to pass therethrough while preventing users from coming in contact with the fan blades 121, and further prevents larger objects and debris that may damage the fan blades 121 and/or injure users from entering the fan blades 121. According to one or more embodiments, the front grill 133 and/or the rear grill 135 may be structured as a plurality of concentric circular wire structures and a plurality of radial wire structures connecting the circular wire structures. According to one or more embodiments, a front plate 131 may be disposed at a center portion of the front grill 133. The front plate 131 may cover only the fan hub 123 or a portion thereof such that airflow from the fan blades 121 is not blocked thereby. The motor housing 113 may be disposed on a back side of the rear grill 135. A back plate may be attached to the rear grill 135, and the motor housing 113 may extend rearward from the back plate. Support ribs may extend between the back plate and the motor housing 113 to provide strength and stiffness. The back plate, the support ribs, and the motor housing 113 may be formed integrally as a single piece.

According to one or more embodiments, the fan assembly 100 includes a stand 150 that includes a pair of floor support portions 153, and a pair of right vertical portions 151 and a pair of left vertical portions 155 that extend upward from the floor support portions 153. The pair of right vertical portions 151 are joined at upper ends thereof to form a U-shaped elbow, and the pair of left vertical portions 155 are joined at upper ends thereof to form a U-shaped elbow. According to one or more embodiments, first and second shroud hinge supports 141, 145 are fixed on right and left sides of the shroud 200, and plates disposed at the U-shaped elbows of the right and left vertical portions 151, 155 are rotatably connected to the first and second shroud hinge supports 141, 145 via first and second hinge shafts 143, 147 that extend in left and right directions, respectively. Thus, the shroud 200 may rotate with respect to the stand 150 about a lateral axis that contains the left and right directions, allowing the fan to be angled upward and downward. The stand 150 may further include a pair of wheels 156 that are connected via a wheel shaft 157 that is rotatably disposed on plates disposed at the junction of the floor support portions 153 and the right vertical portions 151. When the left vertical portions 155 are lifted, the wheels 156 allow a user to roll the fan assembly 100 in the left direction. The fan assembly 100 may further include pair of weights 158 on the floor support portions 153 to anchor the fan assembly 100. The weights 158 may be sleeve-shaped and may be disposed closer to the left vertical portions 155 than the right vertical portions 151. Additionally, as shown in FIG. 2, a battery receptacle 163 may be disposed on the left vertical portions 155 via attachment sleeves 161 on the front and rear ends of the battery receptacle. Additionally, the battery receptacle 163 may include a printed circuit board assembly, or PCBA 164, disposed within a PCBA housing 165 formed on the battery receptacle 163. The PCBA 164 may include circuitry for the battery pack that is disposed on the battery receptacle 163. An electrical wire 115 may connect the PCBA 164 to the motor 111 to drive the motor 111 when a battery pack is disposed on the battery receptacle 163. As shown in FIG. 2, the electrical wire 115 may be attached to a back of the rear grill 135.

Figure 5:
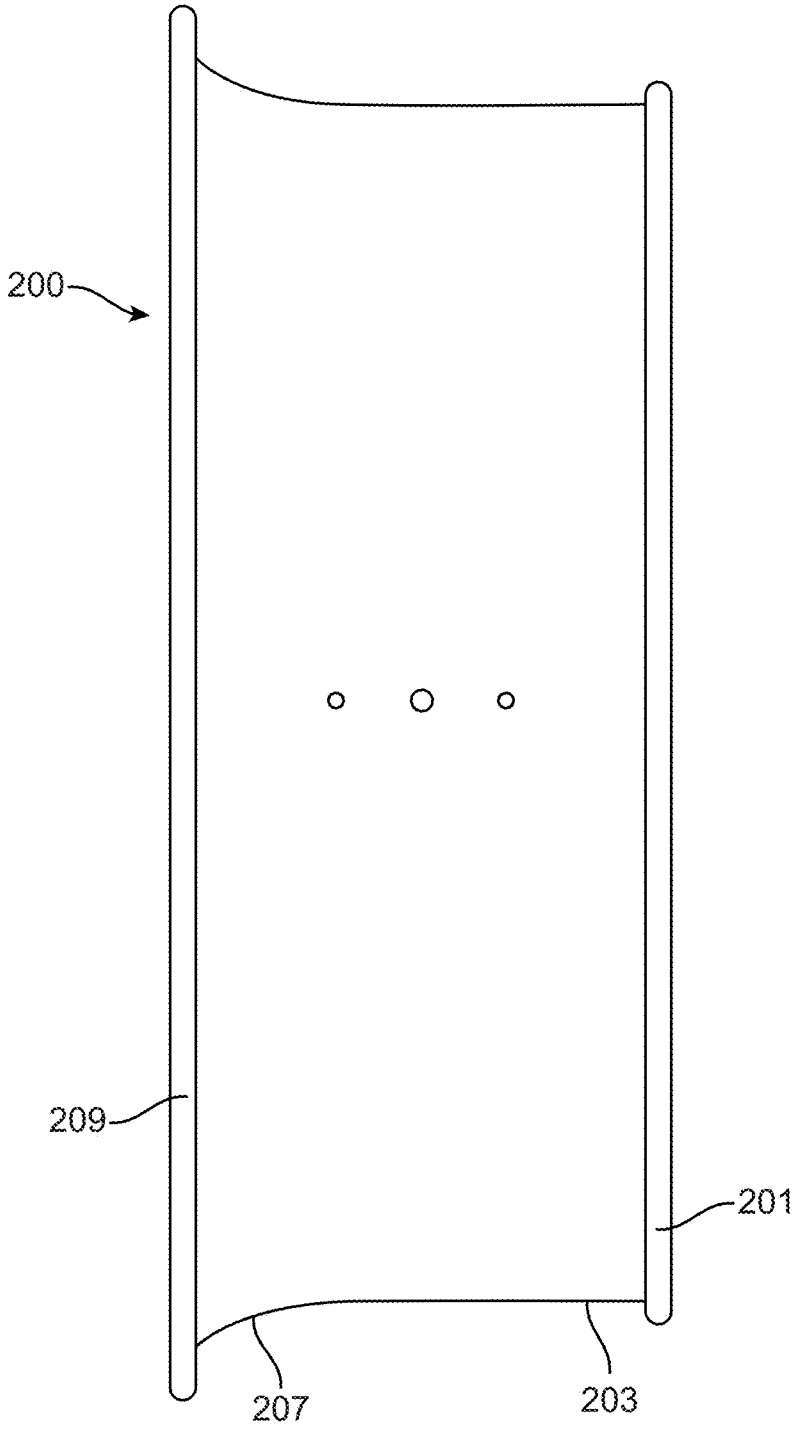
FIG. 5 shows a side view of a fan shroud according to one or more embodiments.

FIG. 5 shows a side view of a fan shroud 200 according to one or more embodiments. When power is provided to the motor 111 from the battery pack on the battery receptacle 163, the fan blades 121 rotate to generate airflow from the rear side of the fan assembly 100 to the front side of the fan assembly. As such, the fan shroud 200 will be described in airflow order from the rear end thereof to the front end thereof. According to one or more embodiments, the fan shroud 200 may include a rear lip 209 at a rearmost end of the fan shroud 200, a converging section 207 extending forward from the rear lip 209 that gradually decreases in diameter toward the front, a constant diameter section 203 extending forward from the converging section 207, and a front lip 201 at a frontmost end of the fan shroud 200. As shown in FIG. 5, the converging section 207 may have a curved profile from the rear lip 209 to the constant diameter section 203. The front and rear lips 201, 209 may provide stiffness to the front and rear ends of the fan shroud 200 and may further blunt the front and rear ends of the fan shroud 200 so that they do not injure a user. Both the inner and outer diameters of the fan shroud 200 decrease in diameter in the converging section 307 toward the forward direction.

As shown in FIG. 4, the fan blades 121 may be disposed within the constant diameter section 203 of the fan shroud 200. Thus, rotation of the fan blades 121 pulls airflow from a rear of the fan shroud 200 through the converging section 207 to the constant diameter section 203, and the airflow through the constant diameter section 203 exits a front of the fan shroud 200. The decrease in diameter in the airflow direction via the converging section 207 provides improvement in performance.

Figure 6:
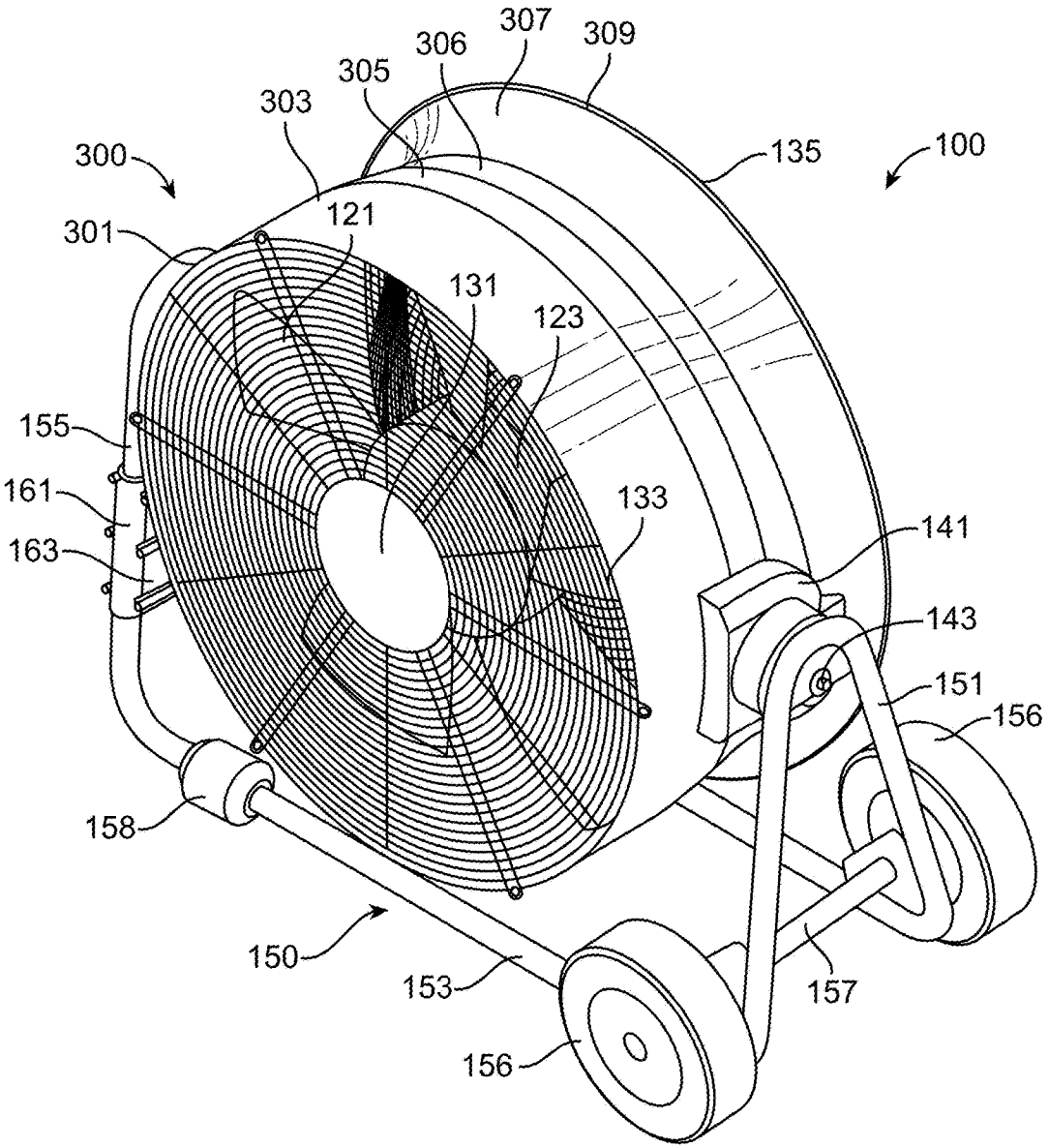
FIG. 6 shows a front perspective view of a fan assembly according to one or more embodiments.
Figure 7:
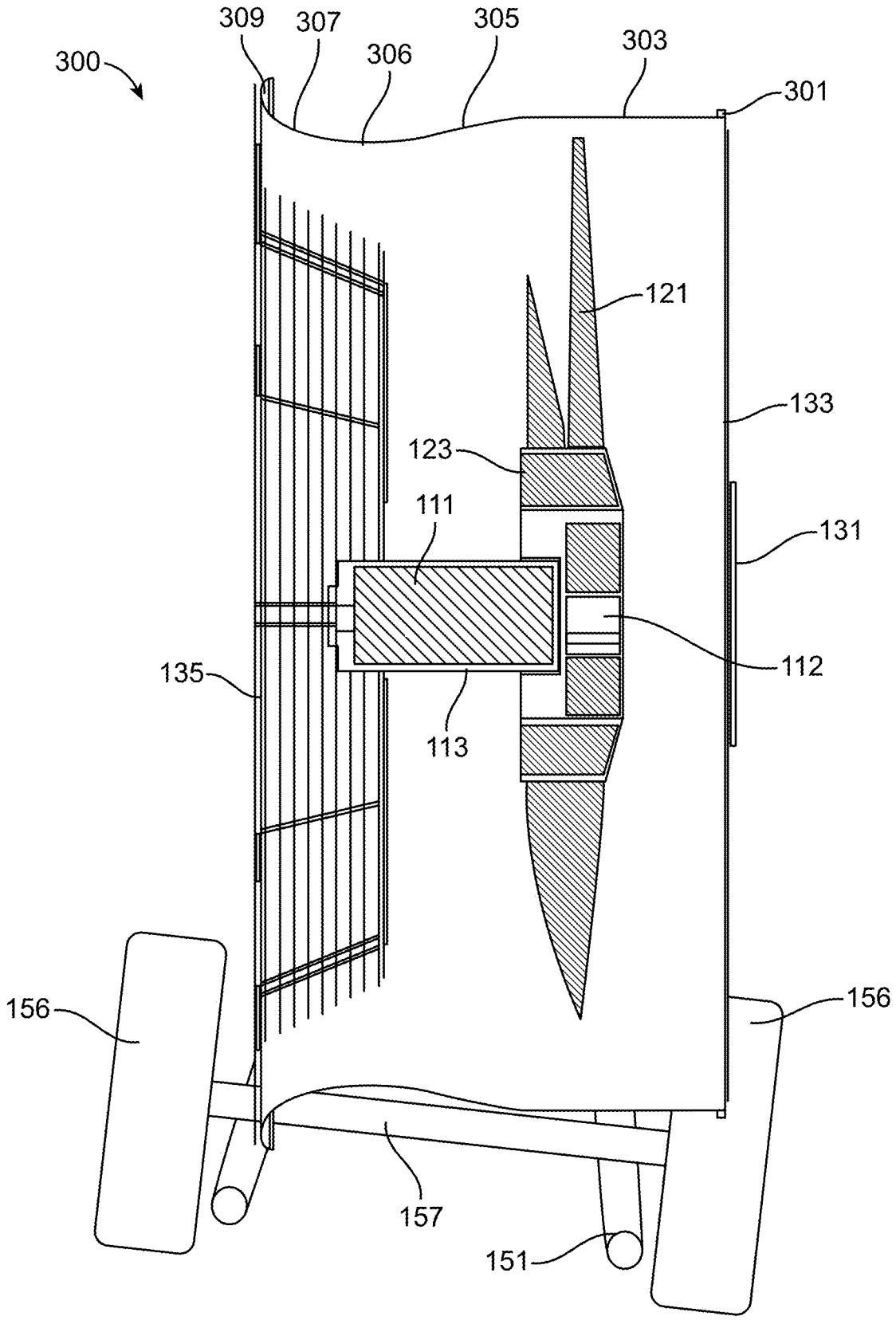
FIG. 7 shows a side cross-sectional view of a fan assembly according to one or more embodiments.
Figure 8B:
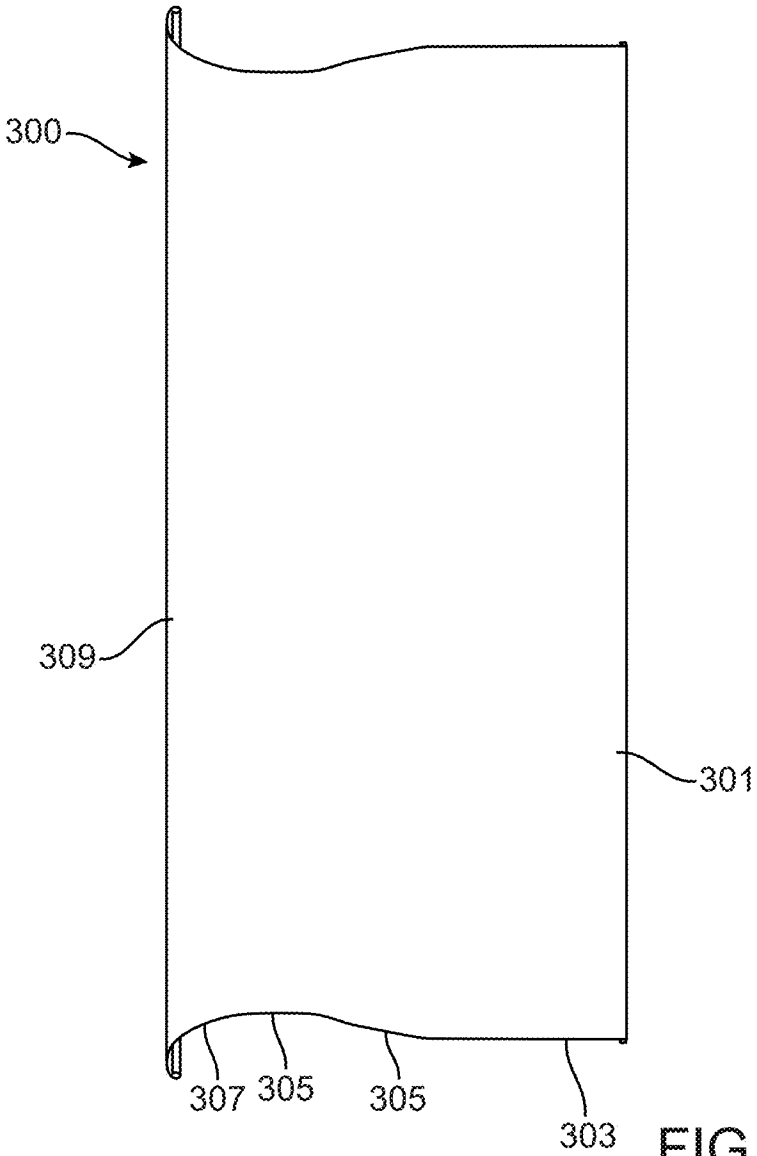
FIG. 8B shows a side cross-sectional view of a fan shroud according to one or more embodiments.
Figure 8A:
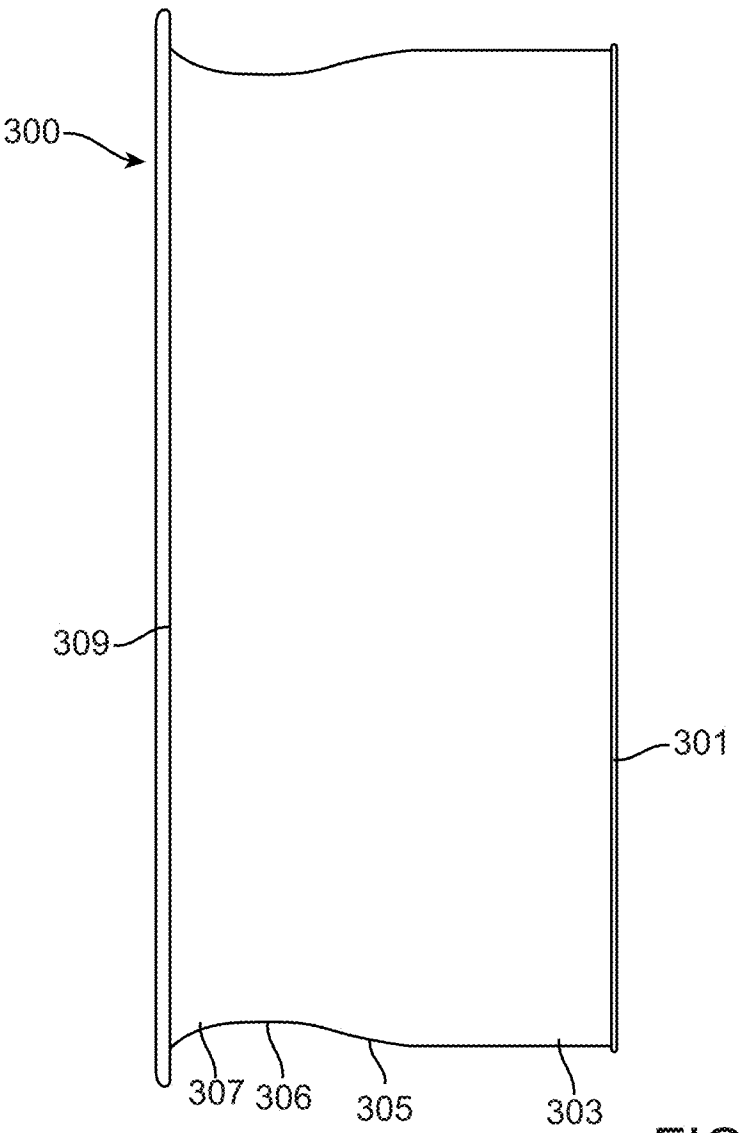
FIG. 8A shows a side view of a fan shroud according to one or more embodiments.

FIG. 6 shows a front perspective view of a fan assembly 100 according to one or more embodiment, and FIG. 7 shows a side cross-sectional view of a fan assembly 100 according to one or more embodiments. The fan assembly shown in FIGS. 6-7 are similar to that shown in FIGS. 1-4, although the fan assembly of FIGS. 6-7 includes a modified fan shroud. Specifically, the fan assembly 100 includes a fan shroud 300 with a different profile. FIGS. 8A and 8B show a side view and a cross-sectional side view of a fan shroud 300 according to one or more embodiments.

According to one or more embodiments, the fan shroud 300 includes, in airflow order, a rear lip 309 at a rearmost end of the fan shroud 300, a converging section 307 extending forward from the rear lip 309 that gradually decreases in diameter toward the front, an inflection point 306 at which the converging section 307 transitions to a diverging section 305 extending forward from the converging section 307 that gradually increases in diameter toward the front, a constant diameter section 303 extending forward from the diverging section 305, and a front lip 301 at a frontmost end of the fan shroud 300. As shown in FIGS. 8A-8B, the converging section 307 may have a curved profile from the rear lip 309 to diverging section 305, and the diverging section 305 has a curved profile from the converging section 307 to the constant diameter section 303. The front and rear lips 301, 309 may provide stiffness to the front and rear ends of the fan shroud 300 and may further blunt the front and rear ends of the fan shroud 300 so that they do not injure a user. As shown in the side cross-sectional view of FIG. 8B, both the inner and outer diameters of the fan shroud 300 decrease in diameter in the converging section 307 toward the forward direction and increase in diameter in the diverging section 305 toward the forward direction. According to one or more embodiments, the constant diameter section 303 has a length in the airflow direction greater than the diverging section 305 and greater than the converging section 307. According to one or more embodiments, the constant diameter section 303 has a length in the airflow direction less than a combination of the diverging section 305 and the converging section 307.

As shown in FIG. 7, the fan blades 121 may be disposed within the constant diameter section 303 of the fan shroud 300. Thus, rotation of the fan blades 121 pulls airflow from a rear of the fan shroud 300 through the converging section 307 and through the diverging section 305 to the constant diameter section 303, and the airflow through the constant diameter section 303 exits a front of the fan shroud 300.

The decrease in diameter in the airflow direction via the converging section 307 provides improvement in performance. Additionally, a diverging section 305 downstream of the converging section 307 allows for the maximum diameter of the fan shroud 300 to be reduced, which decreases the size and weight of the fan assembly 100. This reduction in the maximum diameter of the fan shroud 300 also allows for smaller packaging which reduces packaging and transport costs, while unexpectedly maintaining most of the performance improvement of the converging section 307.

Figure 9:
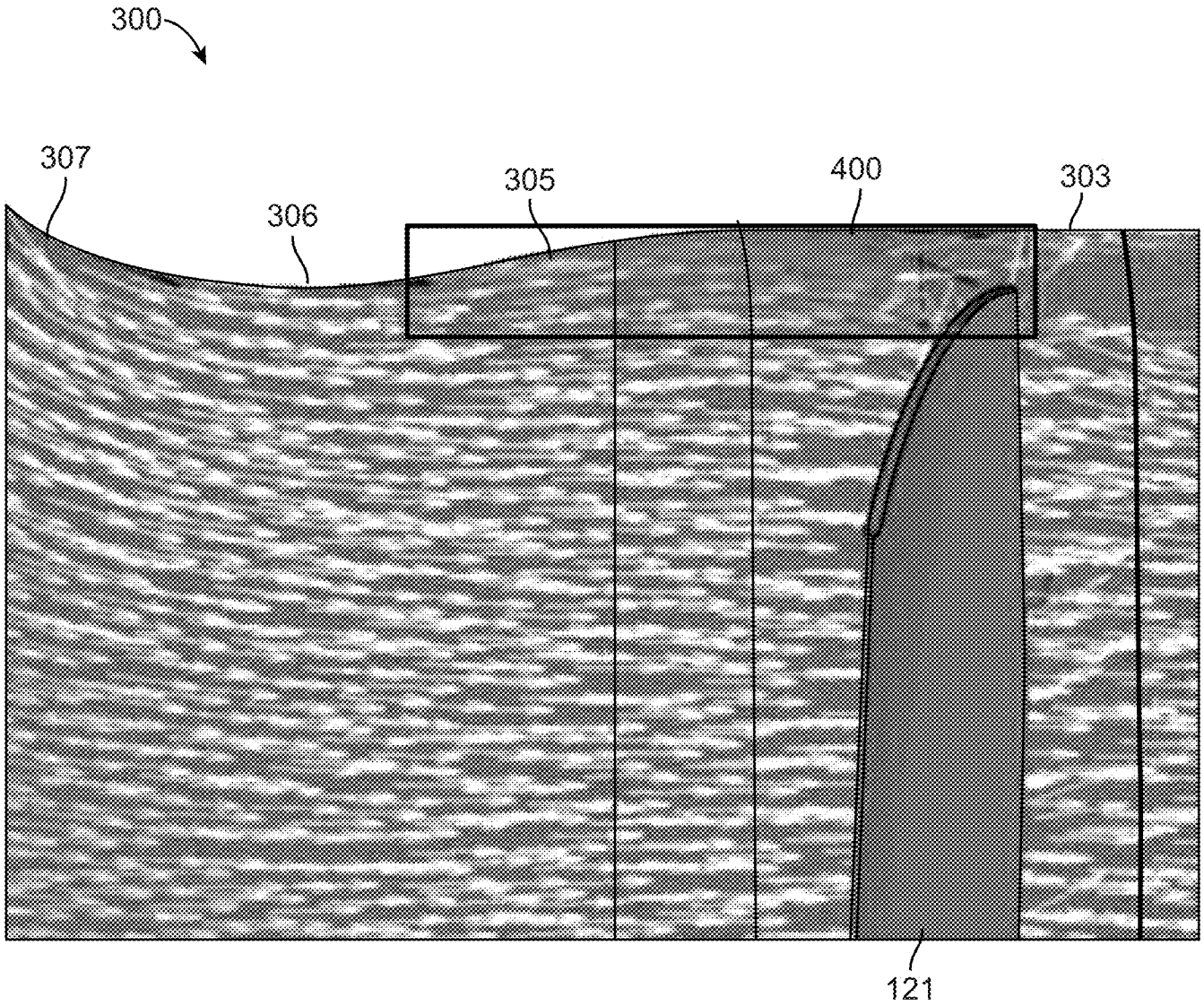
FIG. 9 shows airflow through a portion of a fan shroud according to one or more embodiments.

FIG. 9 shows airflow through a portion of a fan shroud 300 according to one or more embodiments. A fan shroud with only a converging section and a constant diameter section may produce flow separation at the inner wall of the fan shroud at the converging section, which results in flow rate loss and increased noise. As shown in FIG. 9, positioning a diverging section 305 downstream of the converging section 307 increases flow attachment (illustrated by reference numeral 400) at the inner wall of the shroud at the diverging section 305, and the flow attachment 400 continues downstream of the diverging section 305 to the constant diameter section 303. The increased flow attachment of airflow entering the fan 121 improves airflow and efficiency while suppressing the increase in noise. Thus, the fan assembly 100 achieves high airflow while providing high aerodynamic efficiency and suppressing noise.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A fan assembly comprising:

a motor having an output shaft;

a plurality of fan blades coupled to the output shaft and configured to be rotated by the output shaft when the motor is actuated to generate airflow in an airflow direction; and a fan shroud surrounding the plurality of fan blades, wherein the fan shroud comprises a converging section having an inner diameter that decreases in the airflow direction, and a constant diameter section downstream of the converging section in the airflow direction that has a substantially constant diameter, wherein the converging section surrounds at least a portion of the motor.

2. The fan assembly of claim 1, wherein the fan shroud further comprises a diverging section downstream of the converging section and upstream of the constant diameter section, and wherein the diverging section has an inner diameter that increases in diameter in the airflow direction.

3. The fan assembly of claim 2, wherein the constant diameter section of the fan shroud surrounds an entirety of the plurality of fan blades.

4. The fan assembly of claim 2, wherein the diverging section surrounds at least a portion of the motor.

5. The fan assembly of claim 2, wherein a first portion of the motor is surrounded by the converging section, a second portion of the motor is surrounded by the diverging section, and a third portion of the motor is surrounded by the constant diameter section.

6. The fan assembly of claim 2, wherein a rear grill is disposed upstream of the fan blades, and wherein the rear grill extends in the airflow direction from the converging section to the diverging section.

7. The fan assembly of claim 2, wherein a length of the constant diameter section in the airflow direction is greater than a length of the diverging section in the airflow direction.

8. The fan assembly of claim 2, wherein a length of the constant diameter section in the airflow direction is less than a length of a combination of the converging section and the diverging section and in the airflow direction.

9. The fan assembly of claim 1, wherein the constant diameter section of the fan shroud surrounds an entirety of the plurality of fan blades.

10. The fan assembly of claim 1, wherein a majority of the converging section has a smaller diameter than a diameter of the constant diameter section.

11. The fan assembly of claim 1, further comprising a first lip upstream of the converging section and a second lip downstream of the constant diameter section.

12. The fan assembly of claim 1, further comprising a battery receptacle disposed on the fan shroud electrically connected to the motor and configured to receive a battery pack to provide power to the motor.

13. The fan assembly of claim 1, wherein a length of the constant diameter section in the airflow direction is greater than a length of the converging section in the airflow direction.

14. The fan assembly of claim 1, further comprising a printed circuit board assembly and an electrical wire connecting the printed circuit board assembly to the motor, wherein the motor is configured to be driven via the electrical wire, and wherein the converging section surrounds a portion of the electrical wire.

15. A fan shroud configured to have airflow therethrough in an airflow direction and comprising:

a converging section having an inner diameter that decreases in the airflow direction;

a constant diameter section downstream of the converging section in the airflow direction that has a substantially constant diameter; and a diverging section downstream of the converging section and upstream of the constant diameter section, the diverging section having an inner diameter that increases in the airflow direction, wherein a length of the constant diameter section in the airflow direction is greater than a length of the diverging section in the airflow direction.

16. The fan shroud of claim 15, wherein a majority of the converging section has a smaller diameter than a diameter of the constant diameter section.

17. The fan shroud of claim 15 further comprising a first lip upstream of the converging section and a second lip downstream of the constant diameter section.

18. The fan shroud of claim 15, wherein the converging section transitions to the diverging section at an inflection point on the fan shroud.

19. A fan shroud configured to have airflow therethrough in an airflow direction and comprising:

a converging section having an inner diameter that decreases in the airflow direction;

a constant diameter section downstream of the converging section in the airflow direction that has a substantially constant diameter; and a diverging section downstream of the converging section and upstream of the constant diameter section, the diverging section having an inner diameter that increases in the airflow direction, wherein a length of the constant diameter section in the airflow direction is less than a length of a combination of the converging section and the diverging section in the airflow direction.

* * * * *